United States Patent [19]

Zacharin

[11] Patent Number: 4,696,443

[45] Date of Patent: Sep. 29, 1987

[54] SCATTERABLE RAM AIR DECELERATOR

[76] Inventor: Alexey T. Zacharin, 37 Copeland Rd., Denville, N.J. 07834

[21] Appl. No.: 821,035

[22] Filed: Jan. 21, 1986

[51] Int. Cl.[4] ..... B64D 17/80

[52] U.S. Cl. ..... 244/113; 244/138 R; 102/386

[58] Field of Search ..... 244/138 R, 138 A, 142, 244/145, 152, 110 D, 113; 102/337, 339, 348, 354, 386, 387, 384

[56] References Cited

U.S. PATENT DOCUMENTS

| | | | |
|---|---|---|---|
| 1,537,713 | 5/1925 | Sperry et al. | 102/387 |
| 2,819,856 | 1/1958 | Hight | 244/138 R |
| 3,105,658 | 10/1963 | Marshall et al. | 244/138 R |
| 4,005,655 | 2/1977 | Kleinschmidt et al. | 244/138 R |
| 4,565,341 | 1/1986 | Zacharin | 244/138 R |

*Primary Examiner*—Jeffrey V. Nase
*Assistant Examiner*—Rodney Corl
*Attorney, Agent, or Firm*—Pennie & Edmonds

[57] ABSTRACT

The present invention relates to an improvement in a collapsible decelerator for aerial bombs launched from a high velocity vehicle and designed to provide a high drag stabilizer capable of withstanding release in air stream velocities from subsonic to transonic. The decelerator preferably includes a hollow inflatable star, the outermost points of which have hooded valve openings through which regulated airflow enters and inflates the star to decelerate the munition to which it is attached. The improvement comprises an offset mounting piece to create a side force on the decelerator, expanding the coverage pattern of deployed bodies. The amount of offset controls the magnitude of the side or lateral force on the device during descent.

10 Claims, 6 Drawing Figures

SCATTERABLE RAM AIR DECELERATOR

FIELD OF THE INVENTION

This invention relates to inflatable decelerators for deployment of bodies launched from high velocity vehicles.

BACKGROUND OF THE INVENTION

When a retarding mechanism and a body suspended therefrom are launched from an aircraft, dispenser or missile at high speed, deployment of a decelerator may cause a severe shock due to a sudden retardation. A collapsible decelerating mechanism such as the one taught in U.S. Pat. No. 4,565,341, copending herewith, to be issued to the present inventor, provides many advantages over prior art retarding mechanisms. The inflatable decelerator described therein permits successful deployment at speeds from subsonic to supersonic, assures proper and fast inflation, and retains structural integrity. Following deployment, the retarding device provides deceleration and stabilization for the suspended body. The retarding device, from the moment of deployment and full inflation, functions also as a means of dispersing the suspended body. It is also highly desirable for certain launched or dispersed bodies to disperse over a wide area not attainable with prior art designs.

A dispensing means for deployment of bodies is commonly cigar-shaped, and rotates during dispensing. Consequently the pattern for coverage of a series of suspended bodies, using conventional retarding means, is doughnut-shaped. The doughnut shape is far from ideal, since a no-coverage opening exists in the center, and the circumference of the outer edge of the doughnut pattern is the limit of the coverage.

The present invention addresses the need in the art for broad and patterned coverage in bomblet or other aerially-released body dispersal.

SUMMARY OF THE INVENTION

The present invention pertains to an improvement over U.S. Pat. No. 4,565,341. The device was designed to provide a high drag deceleration with minimum deviation from a vertical trajectory. However, in many cases, a horizontal motion away from the vertical trajectory is desirable.

A decelerator according to the present invention comprises a hollow inflatable star-shaped body, the outermost points of which have hooded valve openings through which regulated airflow enters and inflates the star-shaped body to decelerate the munition to which it is attached. The inventive improvement comprises an eccentrically-located mounting member which is offset along a center line formed between a lobe of the star, and an indented portion between two opposite lobes. The offset is preferably toward the indented portion. The offset is provided so that a side force is developed during descent of a suspended body, the side force enabling a broader coverage for dispersed bodies. The amount of the offset controls the magnitude of the side force (within the limits of the design) and therefore determines the dispersal magnitude of a given suspended body. This force is obtained by having one lobe project into the air stream a greater amount than the remaining lobes. Offsetting the mounting alters the aerodynamic characteristics and flight path of the decelerator in an airstream. In this manner, a desired coverage pattern may be achieved by varying the amount of offset of the mountings in a given series of decelerator devices.

Further objects and advantages of the present invention will become apparent from the following detailed description to be taken in conjunction with the drawings.

DETAILED DESCRIPTION OF THE INVENTION

Figure 1:
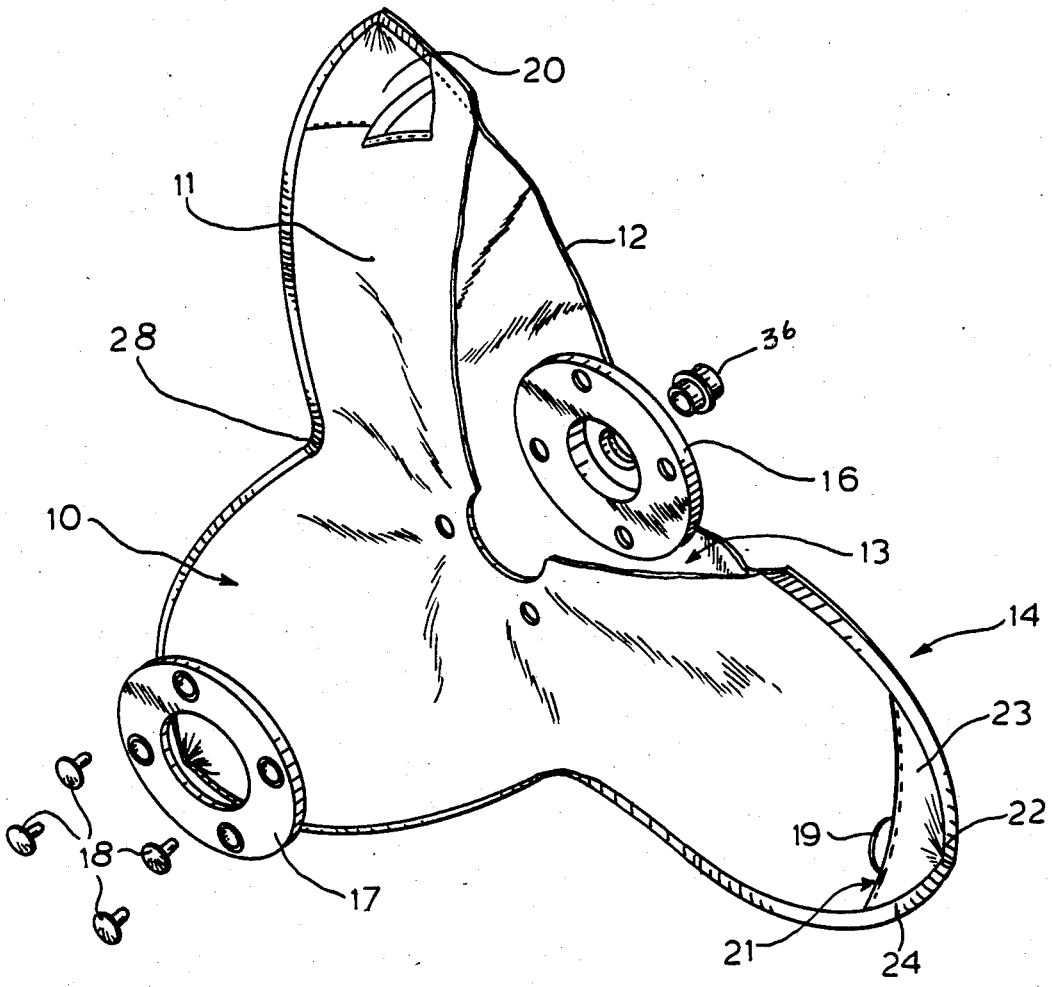
FIG. 1 is an exploded perspective view, partly broken away, of an inflatable decelerator.
Figure 2:
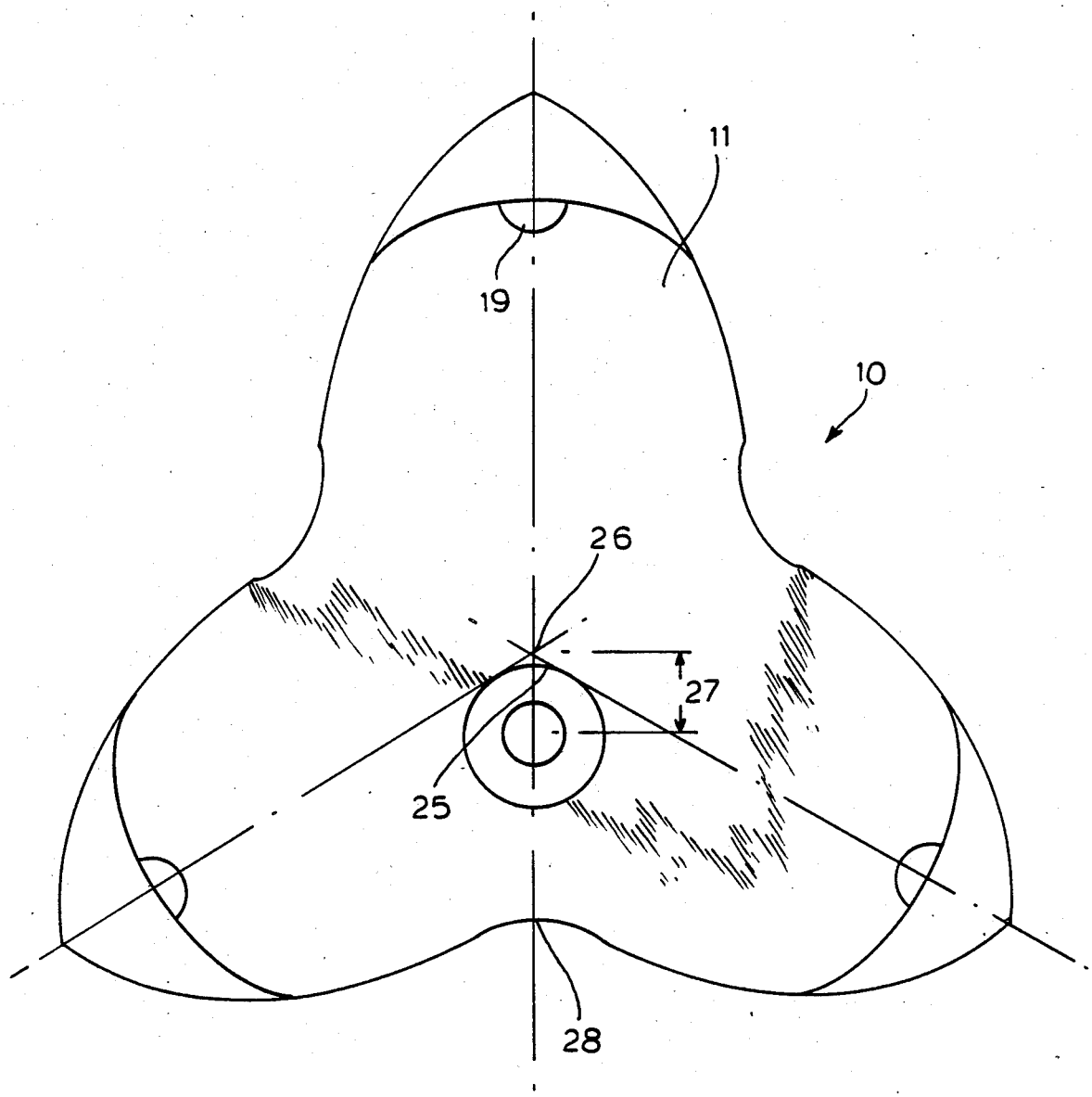
FIG. 2 is a bottom plan view of a decelerator device according to the present invention illustrating the mounting assembly offset from the decelerator center.
Figure 4:
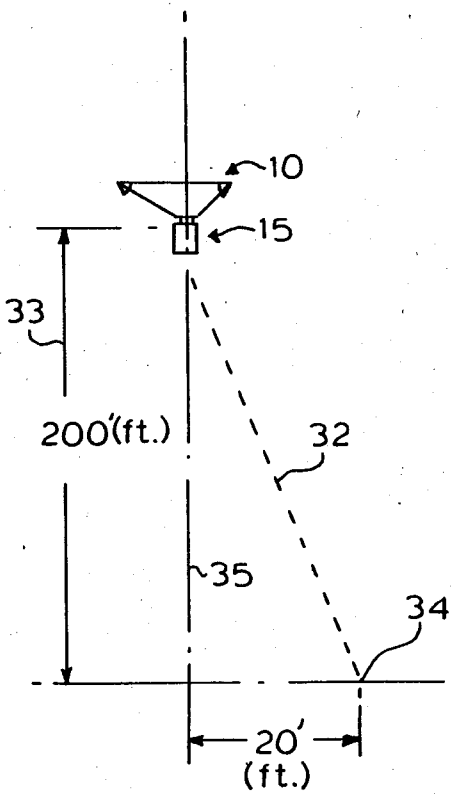
FIG. 4 depicts the resultant trajectory attainable by the subject inventive structure.
Figure 3:
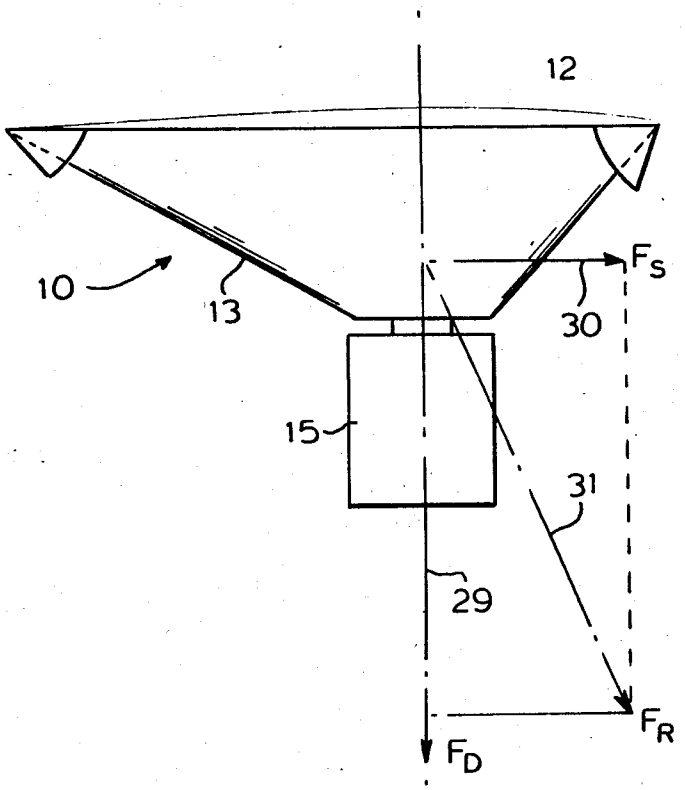
FIG. 3 is a side view depicting the relationship between the drag force, the side force and the resultant force upon the present invention during descent and having a body suspended therefrom.

Referring to the drawings, in FIG. 1, the decelerator 10 may be seen to have a shape generally analogous to an essentially flat star illustratively having three radially symmetric outwardly projecting lobes 11. The decelerator of FIG. 1 illustrates the shape of the inflatable chamber of the preferred embodiment and does not illustrate an offset mounting means, which is illustrated in FIGS. 2–4. The essentially star-shaped decelerator 10 is constructed by joining a flat top panel 12 to a panel 13 which is slightly larger in area, but has an equal perimeter to panel 12. Panels 12 and 13 are joined about their respective peripheries by continuous stitching in the manner suggested by seam 14 coextensive with the outer distal edges of both panels. Panel 13 contains sufficient material so as to form a slightly conical shape when chamber 10 is fully inflated. This shape is illustrated in FIG. 3 wherein upper top panel 12 is substantially flat or planar, while bottom panel 13 provides greater depth at the center of chamber 10 than at the outer extremities of the lobes 11. Each of the lobes 11 is an elongate inflatable compartment contiguous with the axial center portion of chamber 10.

Attachment of the chamber 10 to body 15 is done by the use of inner plate 16 having a swedged miniature clinch-nut 36 cemented to the inside of lower panel 13, while outer plate 17 is cemented to the outside of panel 13. The inner plate 16 and the outer plate 17 are also secured to each other by a plurality of rivets such as 4 equidistantly spaced rivets of the type shown, rivets 18. Both inner and outer plates 16 and 17 may be of any other design having provisions to attach to a body, and they comprise mounting assembly 25 shown in FIG. 2.

Of critical importance to the invention is the addition of at least one hole proximate to the outer distal edge of each lobe 11 as shown illustratively by hole 19 in FIG. 1. It is through the three holes thus formed that airflow necessary for inflation of chamber 10 occurs. Since the launch speed is based upon the operating characteristics of the aircraft, dispenser or missile from which it is launched, the airflow rate into chamber 10 can be adjusted according to the size of holes 19 in the lobes 11.

Also of importance to the aerodynamics of the preferred embodiment, along with the starlike shape of chamber 10, is the use of scuppers or hoods over each hole 19 such as scuppers 20 seen in FIG. 1. Each of the three scuppers form an upstanding covering over each of the holes 19 respectively, but spaced apart therefrom to engage or capture a small portion of the external airflow around chamber 10 and scoop such portion into the pocket so that it will be directed into the hole 19 covered by the pocket. Thus each pocket as suggested by scupper 20 in FIG. 1 has an open-end portion 21, a blind closure end portion 22, and side portions 23 and 24 extending therebetween. These portions comprise surfaces which slope from the open-ended air inlet area 21 toward blind terminus 22 from which there is no outlet or escape, whereby airflow entering the inlet 21 is forced through hole 19 and thence into chamber 10.

Of particular and critical importance is the location of the mounting assembly 25 with respect to the decelerator center 26, shown in FIG. 2. This offset 27 is located on the center line formed between lobe 11 and through indentation 28.

The offset is preferably located toward indentation 28 relative to center axis 26. It has been found that offsetting mount 25 toward indentation 28 provides good stability during descent. However, offsetting mount 25 toward lobe 11 has been found to cause wobbling and instability during descent. The amount of offset 27 controls decelerator 10 radial symmetry about its axis and thus the projected area to the air stream.

FIG. 3 depicts forces acting on the decelerator. Force $F_S$ is a side or lateral, or horizontal force resulting from the eccentrically mounted mounting portion. Drag force ($F_D$) 29 is a function of decelerator total projected area; however, side force ($F_S$) 30 is the result of asymmetry created by the offset 27. Resultant force ($F_R$) 31 influences the trajectory 32 of the decelerator as suggested in FIG. 4. As an example, for a certain offset 27, a specific decelerator 10 having a specific body 15 attached thereto and deployed at a specific velocity from an altitude of 200 ft., 33, will have a resultant trajectory 32 having an impact point 34, 20 feet from vertical 35. Such a trajectory 32 is especially useful when a plurality of bodies 15 are simultaneously deployed from a carrier with the intent of having impact points 34 dispersed over a large area. Decelerators having mounting assemblies located directly at the center thereof will result in a significantly smaller dispersal area of bodies suspended.

Figure 5:
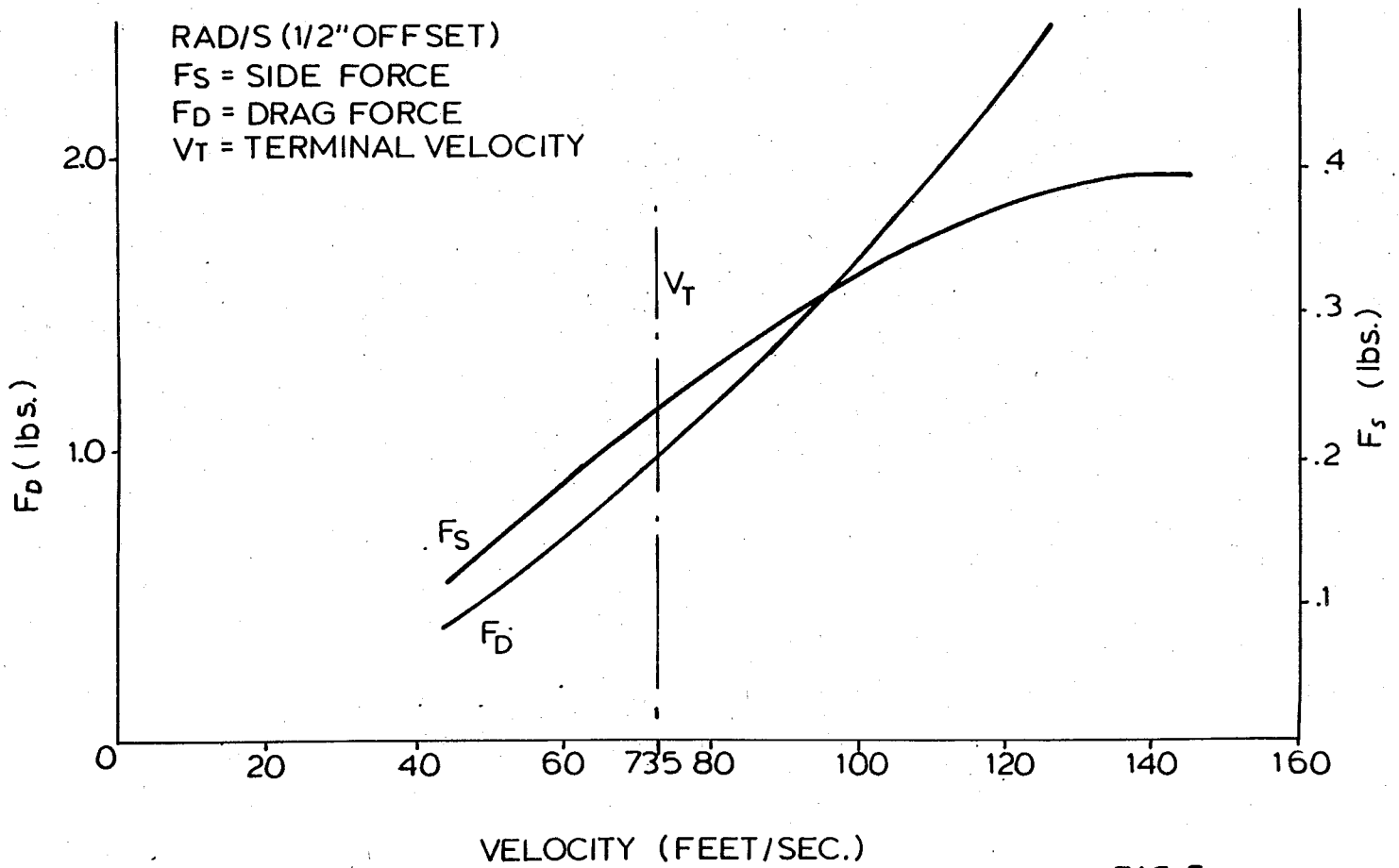
FIG. 5 is a graph depicting an example of the relative magnitude between drag and side forces over a sample velocity.

FIG. 5 is a graph depicting the relative magnitude between drag and side forces over a sample velocity for a ½" offset. Note that the scale for $F_D$ is on the left side of the graph, while the scale for $F_S$ is on the right side of the graph. It is evident that for a specific terminal velocity $V_T$ drag force F. is 1.0 lbs. and side force is 0.23 lbs. It was calculated that if a subject item having an offset of ½ inch, and an initial velocity of V=150 F/S, and an altitude of h=200 ft., it will impact the amount 23 feet off center (FIG. 4).

Figure 6:
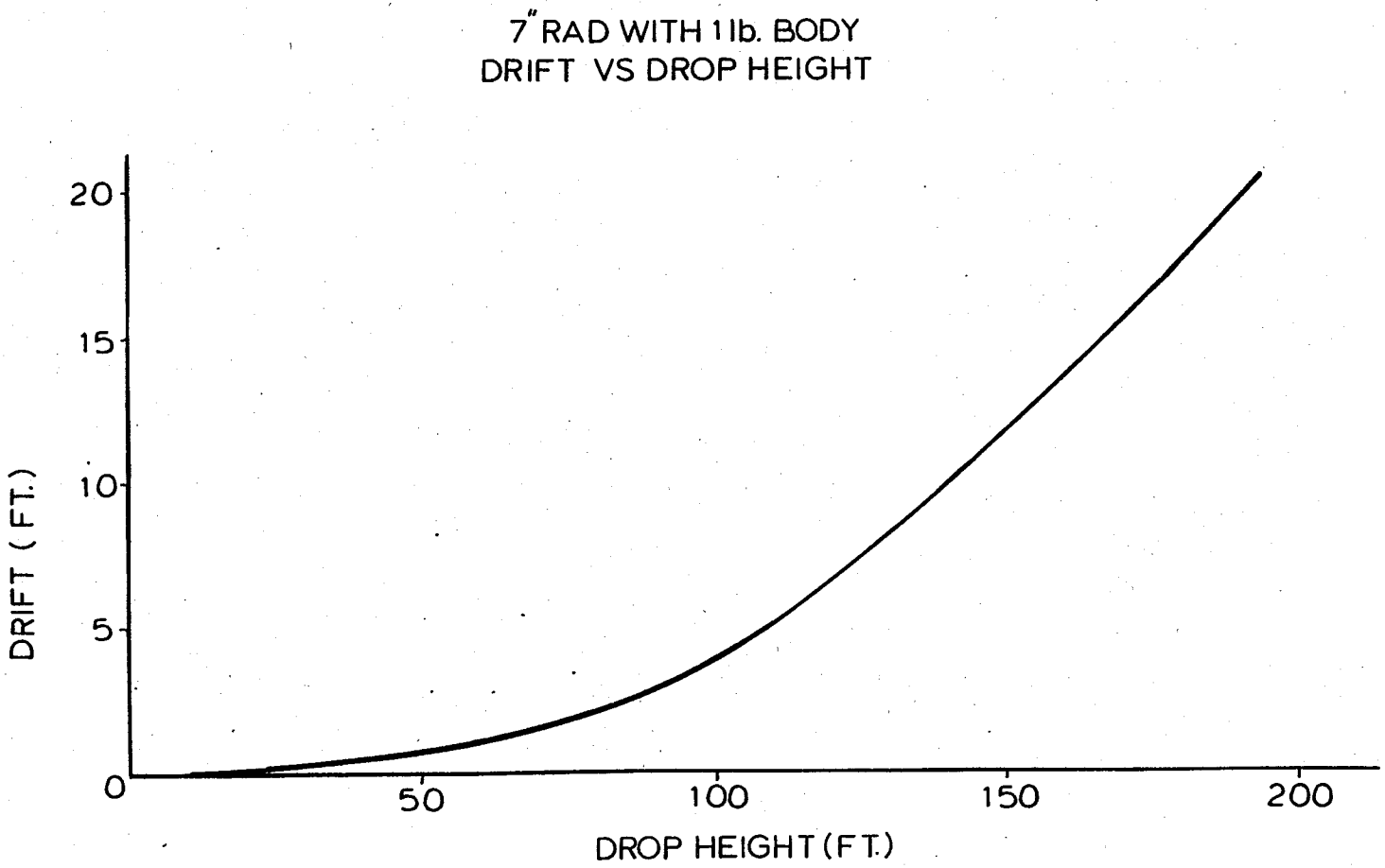
FIG. 6 is a graph comparing an example of drift to drop height. The graph shows one particular RAD size with one particular offset—there are an infinite number of combinations.

FIG. 6 is a graph comparing drift vs. drop height for the decelerator of the present invention.

Obviously, the trajectory of a body suspended by the device described herein is affected by many factors. Wind effects are one example. Wind will effect each body in a substantially similar manner thereby maintaining the desired scope of coverage.

While an illustrative example of the device according to the present invention has been described herein, many variations thereof are possible within the scope of the teachings of this disclosure. Accordingly, the scope of the invention is not to be limited by the example described but rather by the language of the appended claims.

What is claimed is:

1. An inflatable decelerator for deployment with an attached load unit in an airstream comprising:

an inflatable chamber having a center and having a plurality of radially outwardly projecting lobes relative to the center and in spaced-apart relationship to each other;

at least one air inlet means for inletting air to the inflatable chamber;

air scoop means operatively related to each said air inlet means for capturing a portion of external airflow around said chamber and directing said portion into said inlet to inflate said chamber; and a mounting means for mounting a body to the inflatable decelerator, said mounting means being affixed to the inflatable decelerator at a location offset from the center of the inflatable chamber whereby a lateral force is exerted on the decelerator during descent in to an air stream to cause lateral drifting of the decelerator.

2. An inflatable decelerator according to claim 1 wherein the inflatable chamber is generally star-shaped in form, the lobes having distal points and having indented points therebetween, the mounting means being mounted along a line passing from a point of a first lobe, to the indented point between lobes opposite the first lobe.

3. An inflatable decelerator according to claim 2 wherein the mounting means is offset along said line, in a direction toward the indented point from the center of the inflatable chamber.

4. An inflatable decelerator according to claim 3 wherein the amount of offset of the mounting is adapted to control the amount of side force on the decelerator during descent and whereby said offset mounting provides expanded coverage of the load units.

5. An inflatable decelerator according to claim 3 wherein the inflatable chamber is flexibly collapsible, wherein the air inlet means comprises at least one air passage proximate the outer distal end of each lobe, and wherein the air scoop means further comprises an upstanding hood covering each air inlet and spaced apart therefrom.

6. An inflatable decelerator according to claim 3, wherein:

said lobes are three in number.

7. An inflatable decelerator according to claim 4 further comprising:

a payload body;

attachment means on one end of said body for securing said chamber to said body.

8. An inflatable decelerator according to claim 7, wherein:

said payload body comprises a bomblet.

9. An inflatable decelerator according to claim 7, wherein ejection of the decelerator device into an air stream causes the inflatable chamber to be distended and the chamber inflated so as to decelerate and stabilize the payload body.

10. An inflatable decelerator according to claim 7, wherein the lobes are so constructed and arranged about a center vertical axis whereby balanced aerodynamic forces about the axis result upon impact against the lobes in a slightly imbalanced force on the decelerator causing movement of the payload body in a lateral and a vertical direction.

* * * * *